US011538611B2

(12) United States Patent
Liu et al.

(10) Patent No.: US 11,538,611 B2
(45) Date of Patent: Dec. 27, 2022

(54) MAGNETIZATION STABILIZING TREATMENT METHOD FOR PERMANENTLY MAGNETIZABLE MATERIAL

(71) Applicant: NINGBO INSTITUTE OF MATERIALS TECHNOLOGY AND ENGINEERING, CHINESE ACADEMY OF SCIENCES, Ningbo (CN)

(72) Inventors: Lei Liu, Ningbo (CN); Aru Yan, Ningbo (CN); Zhuang Liu, Ningbo (CN); Xin Zhang, Ningbo (CN); Yingli Sun, Ningbo (CN)

(73) Assignee: NINGBO INSTITUTE OF MATERIALS TECHNOLOGY AND ENGINEERING, CHINESE ACADEMY OF SCIENCES, Ningbo (CN)

( * ) Notice: Subject to any disclaimer, the term of this patent is extended or adjusted under 35 U.S.C. 154(b) by 310 days.

(21) Appl. No.: 16/795,558

(22) Filed: Feb. 19, 2020

(65) Prior Publication Data

US 2020/0194152 A1 Jun. 18, 2020

Related U.S. Application Data

(63) Continuation of application No. PCT/CN2018/092622, filed on Jun. 25, 2018.

(30) Foreign Application Priority Data

Jun. 14, 2018 (CN) ..... 201810615444.4

(51) Int. Cl.
*H01F 1/055* (2006.01)
*H01F 13/00* (2006.01)
(Continued)

(52) U.S. Cl.
CPC ..... *H01F 1/055* (2013.01); *H01F 7/02* (2013.01); *H01F 13/003* (2013.01); *H01F 41/02* (2013.01)

(58) Field of Classification Search
None
See application file for complete search history.

(56) References Cited

U.S. PATENT DOCUMENTS 3,891,476 A 6/1975 Naastepad
4,156,623 A 5/1979 Becker
2017/0032876 A1* 2/2017 Nakamura ..... H02K 1/2733

FOREIGN PATENT DOCUMENTS

CN 1614724 A 5/2005
CN 102568808 A 7/2012
(Continued)

OTHER PUBLICATIONS

Machine translation of CN105655074A. (Year: 2016).*
(Continued)

*Primary Examiner* — Xiaowei Su

(57) ABSTRACT

The present disclosure discloses a method for the magnetism stabilizing treatment of a permanent magnet material. The method can include the following steps: providing a permanent magnet material having a positive temperature coefficient of coercivity; magnetizing the permanent magnet material at a temperature $T_3$ with a range of −200 degree centigrades to 200 degree centigrades; and performing a magnetism stabilizing treatment towards the permanent magnet material with temperature decreased in a range of the temperature $T_3$ to a temperature $T_4$, or at the temperature $T_3$.

5 Claims, 4 Drawing Sheets

(51) Int. Cl.
*H01F 41/02* (2006.01)
*H01F 7/02* (2006.01)

(56) References Cited

FOREIGN PATENT DOCUMENTS

| | | | | |
|---|---|---|---|---|
| CN | 103489620 | A | | 1/2014 |
| CN | 105655074 | A | * | 6/2016 |
| CN | 107123497 | A | | 9/2017 |
| JP | 1954002535 | B | | 5/1954 |
| JP | S29-002535 | B | | 5/1954 |
| JP | 2003193127 | A | | 7/2003 |
| JP | 2014099600 | A | | 5/2014 |

OTHER PUBLICATIONS

International Search Report of PCT/CN2018/092622.
Prados et al, Coercivity analysis in sputtered Sm—Co thin films, Journal of Applied Physics, vol. 85, No. 8, Apr. 15, 1999, pp. 6148-6150.
Zheng Li, Design of Permanent Magnet Motor (book), section of Stability of Permanent Magnetic Materials of pp. 19-21, Xi'an Electronic Technology University Press, Xi'an, Feb. 2006.
Renyuan Tang et al, Modern permanent magnet motor theory and design (book), section of Selection and Application of Permanent Magnetic Materials of pp. 34-36, China Machine Press, Beijing, Dec. 1997.
Liu et al, Positive temperature coefficient of coercivity in Sm1—xDyx(Co0.695Fe0.2Cu0.08Zr0.025)7.2 magnets with spin-reorientation-transition cell boundary phases, Applied Physics Letters, Feb. 2, 2015, vol. 106, No. 5, XP012194343.
Notice of Reasons for Refusal dated Mar. 16, 2021 from the Japan Patent Office.

* cited by examiner

MAGNETIZATION STABILIZING TREATMENT METHOD FOR PERMANENTLY MAGNETIZABLE MATERIAL

CROSS-REFERENCE TO RELATED APPLICATIONS

This application is a continuation of PCT/CN2018/092622, filed on Jun. 25, 2018, which claims all benefits accruing under 35 U.S.C. § 119 from China Patent Application No. 201810615444.4, filed on Jun. 14, 2018, in the China National Intellectual Property Administration, the content of which is hereby incorporated by reference.

TECHNICAL FIELD

This disclosure relates to magnetic materials field, and especially to a method for the magnetism stabilizing treatment of a permanent magnet material.

BACKGROUND

Permanent magnet material is widely used in the fields of electric appliances, automobiles, microwave communication, and aerospace and aviation. New requirements continuously arise for permanent magnet materials. For example, when inertial instruments, traveling wave tubes, sensors, and other special devices are operating in a different environment, a weak fluctuation of the permanent magnet material would directly affect the precision of the instruments including the permanent magnet material, causing incalculable risks to the aerospace, aviation, and national defense, limiting execution reliability of unmanned vehicles and intelligent robots, and restricting these developments thereof. Thus, the permanent magnet material with higher magnetism stabilization is desirable.

In general, in the methods for preparing some instruments including the magnet, if the magnet magnetized in advance is reassembled, it would be difficult to install and control position accuracy because of the magnetic force. If the instruments including the non-magnetic magnet are installed, a treatment of high temperature magnetic stabilization is usually required after assembly. The principle of the treatment of the high temperature magnetic stabilization can be as follows: on the one hand, if the treatment is processed at high temperature, the resistance of the magnet itself to demagnetization is weakened; on the other hand, the influence of thermal disturbance is strengthened, and unstable magnetized regions of the magnet are prone to magnetic inversion. Therefore, after treating at the high temperature for a period of time and then returning to a low temperature environment, the magnet can have better time stability, because the magnetic inversion of the unstable magnetized region can reduce an irreversible magnetic flux loss of the magnet during subsequent use.

However, after assembly, due to the constraints of the adhesive colloid, the instruments material itself, etc., it is unable to heat up to an appropriate temperature to process the high temperature magnetic stabilization, causing a technical barrier. In addition, the treatment of the high temperature magnetic stabilization will also damage the microstructure of the magnet and deteriorate the performance of the magnet.

SUMMARY

This disclosure provides a method for magnetism stabilizing treatment of a permanent magnet material. The method can enable the permanent magnet material to achieve rapid magnetic stabilization, reduce the irreversible magnetic flux of the permanent magnet material during subsequent use, and meet application requirements, avoiding the high temperature magnetic stabilization after installation.

A method for magnetism stabilizing treatment of a permanent magnet material can be provided. The method can include the following steps:

providing a permanent magnet material having a positive temperature coefficient of coercivity;

magnetizing the permanent magnet material at a temperature $T_3$ at a range of −200 degree centigrades to 200 degree centigrades; and performing a magnetism stabilizing treatment towards the permanent magnet material at a lower temperature in a range of the temperature $T_3$ to a temperature $T_4$, or at the temperature $T_3$.

In one embodiment, the permanent magnet material can include a microstructure having a first magnetic phase and a second magnetic phase, the first magnetic phase and the second magnetic phase are isolated from each other, the first magnetic phase is a strong magnetic phase, and the second magnetic phase is a magnetic phase with spin reorientation transition.

In one embodiment, the temperature $T_3$ can be in a range of 10 degree centigrades to 40 degree centigrades.

In one embodiment, the permanent magnet material can have the positive temperature coefficient of coercivity in a temperature range of $T_1$ to $T_2$, and the temperature $T_2$ can be higher than or equal to the temperature $T_4$.

In one embodiment, the temperature $T_2$ can be higher than or equal to the temperature $T_3$.

In one embodiment, the positive temperature coefficient of coercivity can be in a temperature range of 10K to 600K.

In one embodiment, an easy magnetization direction of the second magnetic phase can have a convention from easy plane to easy axis as temperature increases.

In one embodiment, the first magnetic phase can be a SmCo compound, the second magnetic phase can be a $RCo_5$ compound, a derivative compound of the $RCo_5$ compound, a $R_2Co_{17}$ compound, a derivative compound of the $R_2Co_{17}$ compound, or a combination thereof, wherein R can be Pr, Nd, Dy, Tb, Ho, or a combination thereof.

In one embodiment, the permanent magnet material can be a Samarium-Cobalt based permanent magnet;

the Samarium-Cobalt based permanent magnet can include a strong magnetic phase of $(SmHreR)_2(CoM)_{17}$ compound and a magnetic phase of $(SmHreR)(CoM)_5$ compound having spin reorientation transition, the $(SmHreR)(CoM)_5$ compound encapsulates the $(SmHreR)_2(CoM)_{17}$ compound in a microstructure of the Samarium-Cobalt based permanent magnet;

Hre can be Gd, Tb, Dy, Ho, Er, Tm, Yb, Lu, or a combination thereof, R is Pr, Nd, Dy, Tb, Ho, or a combination thereof, M is Fe, Cu, Zr, Ni, Ti, Nb, Mo, Hf, W, or a combination thereof, and the SmHreR comprises at least three elements.

In one embodiment, in the Samarium-Cobalt based permanent magnet, a percentage of mass of R can be from 8% to 20%, and a percentage of mass of Hre can be from 8% to 18%.

The method for magnetism stabilizing treatment of the permanent magnet material has many advantages.

Since the permanent magnet material has the positive temperature coefficient of coercivity, the permanent magnet material can be performed the magnetism stabilizing treatment at the temperature $T_3$, or with the temperature is decreased in the range of the temperature $T_3$ to the temperature $T_4$. During this process, the resistance of the permanent magnet material itself to demagnetization is weakened, so the unstable magnetized regions of the permanent magnet material itself are prone to magnetic inversion. Therefore, the permanent magnet material can achieve rapid magnetic stabilization, reduce the magnetic flux, improve the stability of magnetic flux, and reduce irreversible magnetic flux loss rate in subsequent use.

In the method for magnetism stabilizing treatment of the permanent magnet material, the step of magnetizing is performed at the temperature $T_3$, the step of magnetism stabilizing treatment is performed at the temperature $T_3$, or with the temperature decreased in the range of the temperature $T_3$ to the temperature $T_4$. The temperature $T_3$ is higher than the temperature $T_4$. Therefore, compared with the magnetic stabilization process at the high temperature, the permanent magnet material after being magnetized can be achieved easily during the step of magnetism stabilizing treatment without being heated to a higher temperature.

The method for magnetism stabilizing treatment of the permanent magnet material is simple and efficient, and at a lower temperature and time constraint. It can achieve the effect of rapid magnetic stabilization, which can meet the requirements of most instruments to achieve magnetic stabilization after assembly, and more practical.

DETAILED DESCRIPTION

Figure 1:
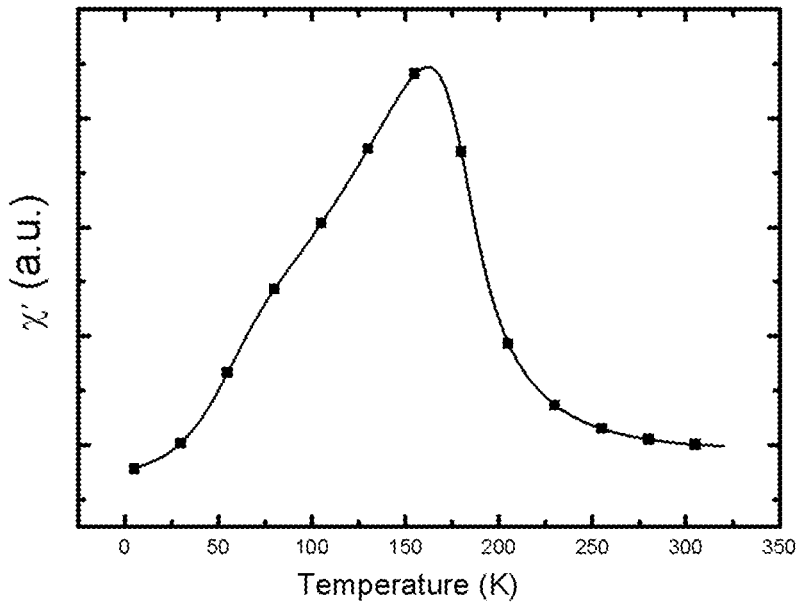
FIG. 1 is an alternating current (AC) magnetic susceptibility test result of the permanent magnet material obtained in embodiment 1 of the present disclosure.

The method for magnetism stabilizing treatment of the permanent magnet material at low temperature provided in the present disclosure will be further described in detail below with reference to the drawings and specific embodiments.

In the art, it is a common method for a high temperature treatment to obtain a magnetic stabilization effect. However, the magnetic stabilization effect is hard to achieve at low temperature processing. The applicant had filed applications (application numbers: CN201410663449.6 and CN201710243774.0) before, which only protect products of permanent magnet materials having positive or low temperature coefficient of coercivity.

A method for a magnetism stabilizing treatment of a permanent magnet material can include the following steps:

S1, providing a permanent magnet material having a positive temperature coefficient of coercivity;

S2, magnetizing the permanent magnet material at a temperature $T_3$ with a range of −200 degree centigrades to 200 degree centigrades; and S3, performing a magnetism stabilizing treatment towards the permanent magnet material at a decreased temperature in a range of the temperature $T_3$ to a temperature $T_4$, or at the temperature $T_3$.

In the step of S1, the material of the permanent magnet material is not limited, as long as it has the positive temperature coefficient of coercivity, such as a commercial ferrite magnet.

In one embodiment, the permanent magnet material can include a microstructure having a first magnetic phase and a second magnetic phase. The first magnetic phase and the second magnetic phase can be isolated from each other. The first magnetic phase can be a strongmagnetic phase, discussed in further detail below, and the second magnetic phase can be a magnetic phase with spin reorientation transition.

A size of the microstructure in at least one dimension can be in a range from about 5 nanometers to about 800 nanometers.

The first magnetic phase and the second magnetic phase can be isolated from each other by encapsulation, interlayer, or both encapsulation and interlayer. For example, the second magnetic phase encapsulates the first magnetic phase, the first magnetic phase encapsulates the second magnetic phase, or the first magnetic phase and the second magnetic phase are alternately stacked with each other layer by layer. An isolation manner between the first magnetic phase and the second magnetic phase depends on the methods for making the permanent magnet material. In order to obtain an isolation structure between the first magnetic phase and the second magnetic phase, the methods for making the permanent magnet material in the present disclosure can be powder metallurgy, sputtering, electroplating, or diffusion. The permanent magnet material made by the methods of sputtering or diffusion can usually have the interlayer isolation manner, and the permanent magnet material made by the methods of powder metallurgy or electroplating can usually have the encapsulation isolation manner.

The second magnetic phase can be a magnetic phase with spin reorientation transition. The magnetic phase with spin reorientation transition can be a $RCo_5$ compound, a derivative compound of the $RCo_5$ compound, a $R_2Co_{17}$ compound, a derivative compound of the $R_2Co_{17}$ compound, or a combination thereof, in which R is Pr, Nd, Dy, Tb, Ho, or a combination thereof. The term "derivative compound" means one element or more than one elements of the $RCo_5$ compound or the $R_2Co_{17}$ compound are partially replaced by other elements. In one embodiment, R can be partially replaced by Sm or by the combination of Sm and Hre, and Co can be partially replaced by M. The Hre can be Gd, Tb, Dy, Ho, Er, Tm, Yb, Lu, or a combination thereof. The M can be Fe, Cu, Zr, Ni, Ti, Nb, Mo, Hf, W, or a combination thereof. For example, $Sm_{1-x}Dy_xCo_5$ (wherein, $0<x<1$) is the derivative compound of the $RCo_5$ compound.

The first magnetic phase can be a strong magnetic phase. The term "strong magnetic phase" of this disclosure can be the magnetic phase with uniaxial anisotropy. In one embodiment, the strong magnetic phase usually can be a SmCo compound, where Sm is partially replaced by Hre or by the combination of Hre and other elements such as the elements of R different from the elements of Hre. In one embodiment, the strong magnetic phase can be the SmCo compound obtained by partially replacing Sm of $Sm_2Co_{17}$, $SmCo_5$, or $SmCo_7$ with Hre and R. In another embodiment, Co can also be partially replaced by M.

In one embodiment, the elements of R and the elements of Hre of the strong magnetic phase can be different, namely, Sm of the SmCo compound can be replaced by at least two elements selected from Hre and R, so that the strong magnetic phase with components of at least three elements can be obtained.

The R, M and Hre of the strong magnetic phase and the R, M and Hre of the magnetic phase with spin reorientation transition can be the same or different. In one embodiment, R of the strong magnetic phase is the same as R of the magnetic phase with spin reorientation transition, M of the strong magnetic phase is the same as M of the magnetic phase with spin reorientation transition, and Hre of the strong magnetic phase is also the same as Hre of the magnetic phase with spin reorientation transition. In general, when the magnetic phases with spin reorientation transition are different, the spin reorientation transition temperatures are also different. For example, an easy magnetization direction of $DyCo_5$ alloy has a convention from easy plane to easy axis at 370K, and the spin reorientation transition temperature of $DyCo_5$ alloy is 370K. The easy magnetization direction of $TbCo_5$ alloy changes from easy plane to easy axis at 410K, and the spin reorientation transition temperature of $TbCo_5$ alloy is 410K. Thus, the spin reorientation transition temperature can be obtained by selecting the magnetic phase with spin reorientation transition, so that the temperature interval of the positive temperature coefficient of coercivity can be obtained.

In one embodiment, the permanent magnet material can be a Samarium-Cobalt based permanent magnet. The Samarium-Cobalt based permanent magnet can mainly consist of elements Sm, Co, Hre, R, and M. Hre can be one or more than one selected from the elements Gd, Tb, Dy, Ho, Er, Tm, Yb, and Lu. R can be one or more than one selected from the elements Pr, Nd, Dy, Tb, and Ho. M can be one or more than one selected from the elements Fe, Cu, Zr, Ni, Ti, Nb, Mo, Hf, and W. The SmHreR can include at least three elements. Furthermore, in the Samarium-Cobalt based permanent magnet, the strong magnetic phase can be a $(SmHreR)_2(CoM)_{17}$ compound, and the magnetic phase with spin reorientation transition can be a $(SmHreR)(CoM)_5$ compound. The $(SmHreR)(CoM)_5$ compound can encapsulate the $(SmHRER)_2(CoM)_{17}$ compound, and the $(SmHreR)(CoM)_5$ compound can be regarded as a cell boundary phase and the $(SmHreR)_2(CoM)_{17}$ compound can be regarded as a intracellular phase.

It can be understood that each of the $(SmHreR)_2(CoM)_{17}$ compound and the $(SmHreR)(CoM)_5$ compound can be a series of compound including the elements Sm, Co, Hre, R, and M, but the ratio of Sm, Hre and R is not limited as 1:1:1, and the ratio of Co and M is not limited as 1:1.

Both Hre and R can include Dy, Tb, Ho, or a combination thereof. The content of Dy, Tb, and Ho in R and the content of Dy, Tb, and Ho in Hre are calculated repeatedly, that is, when Hre includes Dy, Tb, Ho, or a combination thereof, the Dy, Tb and/or Ho of Hre would also be used as the elements of R and used for calculating the percentage of mass of R. For example, when Hre includes Dy, Tb, Ho, or a combination thereof, the percentage of mass of R is the sum of the percentages of mass of Dy, Tb and/or Ho and the percentages of mass of other elements of R different from Dy, Tb and Ho.

In order to obtain the low temperature magnetism stabilizing effect, in the Samarium-Cobalt based permanent magnet of one embodiment, the percentage of mass of R can be in a range from 8% to 20%, and the percentage of mass of HRE can be in a range from 8% to 18%.

Because the easy magnetization axis of the magnetic phase with spin reorientation transition would change as the temperature change. In one embodiment, the easy magnetization direction of the magnetic phase with spin reorientation transition would have a convention from easy plane to easy axis as the temperature rises. Many magnets have the magnetic phase change rule above, such as the Samarium-Cobalt based permanent magnet above.

The permanent magnet material in the present disclosure has the positive temperature coefficient of coercivity in a temperature interval, and the temperature interval of the positive temperature coefficient of coercivity is from $T_1$ to $T_2$. That is, in the temperature range of $T_1$ to $T_2$, the coercivity decreases as the temperature decreases. In one embodiment, the temperature interval of the positive temperature coefficient of coercivity of the permanent magnet material is from 10K to 600K, the permanent magnet material has better magnetic properties. In another embodiment, the temperature interval of the positive temperature coefficient of coercivity of the permanent magnet material is from 100K to 600K, the permanent magnet material has much better magnetic properties. At this time, after low temperature magnetism stabilizing treatment, the permanent magnet material can be highly valuable with practical application. Therefore, the temperature interval of the positive temperature coefficient of coercivity of the permanent magnet material can be preferably from 10K to 600K, and more preferably from 100K to 600K.

The spin reorientation transition temperature of the magnetic phase with spin reorientation transition can determine the temperature interval of the positive temperature coefficient of coercivity in a certain extent. Therefore, the temperature interval of the positive temperature coefficient of coercivity can be adjusted by the spin reorientation transition temperature. Of course, it can also be adjusted by other methods, so that the method for magnetism stabilizing treatment can meet the application of the permanent magnet materials in different aspects.

During the process of performing the magnetism stabilizing treatment towards the permanent magnet material with temperature decreased in the range of the temperature $T_3$ to the temperature $T_4$, or at the temperature $T_3$, the anti-demagnetization ability of the permanent magnet material itself is weakened, so that the easy magnetization direction of the second magnetic phase can change from easy plane to easy axis. During the transformation process, the magnetic crystal anisotropy parameter of the second magnetic phase is very small, which promotes the rapid magnetic inversion of the unstable magnetized regions. Therefore, the permanent magnet material can achieve rapid magnetic stabilization, reduce the magnetic flux, improve stability of the magnetic flux, and reduce the irreversible magnetic flux loss rate during the subsequent use.

In the step of S2, the temperature $T_3$ of magnetizing the permanent magnet material can be −200 degree centigrades to 200 degree centigrades. In one embodiment, the temperature $T_3$ of magnetizing the permanent magnet material in the present disclosure can be 10 degree centigrades to 40 degree centigrades, considering that the higher the temperature of magnetizing the permanent magnet material, the greater the damage to the structure of the permanent magnet material and the greater the difficulty in operation; and meanwhile, in order to complete the process of performing the magnetism stabilizing treatment in the low temperature environment.

In the step of S3, the process of the magnetism stabilizing treatment of the permanent magnet material may be performed at a constant temperature $T_3$, or may be implemented as the temperature decreases within the temperature range from $T_3$ to $T_4$. Of course, in addition to temperature, time is also key element for the magnetism stabilizing treatment of the permanent magnet materials. After magnetized, the permanent magnet material may be in a high-energy state. At this time, if the magnetism stabilizing treatment is performed at the magnetization temperature $T_3$, the permanent magnet material needs a longer time to achieve magnetism stabilization. In the process of magnetism stabilizing treatment with temperature decreased in the range from $T_3$ to $T_4$, because the anti-demagnetization ability of the permanent magnet material itself is weakened, the unstable magnetized regions of the permanent magnet materials can be easy to magnetic inversion. Therefore, the permanent magnet material can achieve rapid magnetic stabilization, reduce the magnetic flux, improve the stability of magnetic flux, and reduce irreversible magnetic flux loss rate in subsequent use. In order to achieve rapid magnetic stabilization, it is preferable to implement the process of magnetism stabilizing treatment as the temperature decreases within the temperature in the range from $T_3$ to $T_4$.

A necessary condition for the permanent magnet materials to achieve rapid magnetic stabilization is that the ability to resist demagnetization is relatively weak. When the temperature of the magnetism stabilizing treatment is higher than the maximum temperature $T_2$ of the temperature interval of the positive temperature coefficient of coercivity, the permanent magnet material itself has a strong ability of demagnetization, and the magnetism stabilizing treatment has little magnetic stabilization effect. Therefore, when the magnetism stabilizing treatment is performed at a constant temperature $T_3$, $T_3$ is better to be lower than or equal to $T_2$, preferably, $T_3$ is lower than $T_2$; and when the magnetism stabilizing treatment is performed as the temperature decreases within the temperature range from $T_3$ to $T_4$, $T_4$ is better to be lower than or equal to $T_2$, preferably, $T_4$ is lower than $T_2$.

When $T_3$ is higher than $T_4$, and $T_2$ is higher than $T_4$, the method for magnetism stabilizing treatment is less affected by temperature and time. At this time, when $T_4$ is lower than or equal to $T_1$, the irreversible magnetic flux loss rate of the permanent magnet material after magnetism stabilizing treatment tends to stabilize and no longer rises as temperature decreases. Therefore, the method for magnetism stabilizing treatment is a more efficient and uniform magnetism stabilizing method.

The method for magnetism stabilizing treatment of the permanent magnet material in the present disclosure does not need to be performed at high temperature, and meets the requirements of application fields that cannot be magnetized at high temperature after installation, which makes up for the shortcomings of high temperature magnetism stabilizing treatment and has more extensive practicability.

The method for low temperature magnetism stabilizing treatment of the permanent magnet material has the following advantages. Firstly, since the permanent magnet material has the positive temperature coefficient of coercivity, the permanent magnet material can be performed the magnetism stabilizing treatment at the temperature $T_3$, or with the temperature is decreased in the range of the temperature $T_3$ to the temperature $T_4$. During this process, the resistance of the permanent magnet material itself to demagnetization is weakened, so the unstable magnetized regions of the permanent magnet material itself are prone to magnetic inversion. Therefore, the permanent magnet material can achieve rapid magnetic stabilization, reduce the magnetic flux, improve the stability of magnetic flux, and reduce irreversible magnetic flux loss rate in subsequent use. Secondly, in the method for magnetism stabilizing treatment of the permanent magnet material, the step of magnetizing is performed at the temperature $T_3$, the step of magnetism stabilizing treatment is performed at the temperature $T_3$, or with the temperature decreased in the range of the temperature $T_3$ to the temperature $T_4$. The temperature $T_3$ is higher than the temperature $T_4$. Therefore, compared with the magnetic stabilization process at the high temperature in the art, the permanent magnet material after magnetized can be achieved easily during the step of magnetism stabilizing treatment without being heated to a higher temperature. Thirdly, the method for magnetism stabilizing treatment of a permanent magnet material is simple and efficient, and has less temperature and time constraint. It can achieve the effect of rapid magnetic stabilization, which can meet the requirements of most instruments to achieve magnetic stabilization after assembly. And it is more practical.

Hereinafter, the method for magnetism stabilizing treatment of the permanent magnet materials will be further described by the following plurality of embodiments.

Embodiment 1

A Samarium-Cobalt based permanent magnet was prepared as following.

The Samarium-Cobalt based permanent magnet consisting essentially of elements Sm, Co, Fe, Cu, Zr, Dy, and Gd was prepared. Percentage of mass of the element of Sm was about 12.87%, percentage of mass of the element of Co was about 50.48%, percentage of mass of the element of Fe was about 13.76%, percentage of mass of the element of Cu was about 6.26%, percentage of mass of the element of Zr was about 2.81%, percentage of mass of the element of Gd was about 2.69%, and percentage of mass of the element of Dy was about 11.13%. Hre was the combination of Gd and Dy with percentage of mass of about 13.82%, Dy was also the element of R, and the percentage of mass of R was about 11.13%.

The method for preparing the Samarium-Cobalt based permanent magnet is as follows:

S100: providing a raw material including elements Sm, Co, Fe, Cu, Zr, Gd, and Dy in accordance with the above percentages of mass;

S200: smelting the raw material in an induction smelting furnace to obtain an alloy ingot, then crushing the alloy ingot to form grains, and jet milling or ball milling the grains to obtain magnet powder;

S300: shaping the magnet powder obtained in step S200 under a protection of nitrogen gas and in a magnetic field with an intensity of about 2 T to form a preform, and then cold isostatic pressing the preform for about 60 seconds under the pressure of about 200 Mpa to obtain a magnet body;

S400: sintering the magnet body obtained in step S300 in a vacuum sintering furnace with an air pressure below 4 mPa and under a protection of argon gas. The process of sintering the magnet body was performed as following: the vacuum sintering furnace was firstly heated to a temperature from 1200 degree centigrades to 1215 degree centigrades and kept at this temperature for about 30 minutes for sintering; the vacuum sintering furnace was then cooled to a temperature from 1160 degree centigrades to 1190 degree centigrades and kept at this temperature for about 3 hours for solid solution; afterwards the vacuum sintering furnace was cooled to room temperature by air cooling or water cooling; the vacuum sintering furnace was heated to about 830 degree centigrades and isothermal aging for about 12 hours at this temperature; the vacuum sintering furnace was cooled to about 400 degree centigrades with a cooling speed of about 0.7 degree centigrades per minute and kept at this temperature for about 3 hours; and then the vacuum sintering furnace was rapidly cooled to room temperature, and finally the Samarium-Cobalt based permanent magnet was obtained.

In this embodiment, the microstructure of the Samarium-Cobalt based permanent magnet was a cellular structure composed of a $(SmHreR)(CoM)_5$ compound and a $(SmHreR)_2(CoM)_{17}$ compound. The $(SmHreR)(CoM)_5$ compound was a cell boundary phase, the $(SmHreR)_2(CoM)_{17}$ compound was a intracellular phase, the crystalline structure of the $(SmHreR)_2(CoM)_{17}$ compound was a rhombic structure, the crystalline structure of the $(SmHreR)(CoM)_5$ compound was a hexagonal structure, and the Cu element concentrates in the $(SmHreR)(CoM)_5$ compound of the cell boundary phase.

Figure 2:
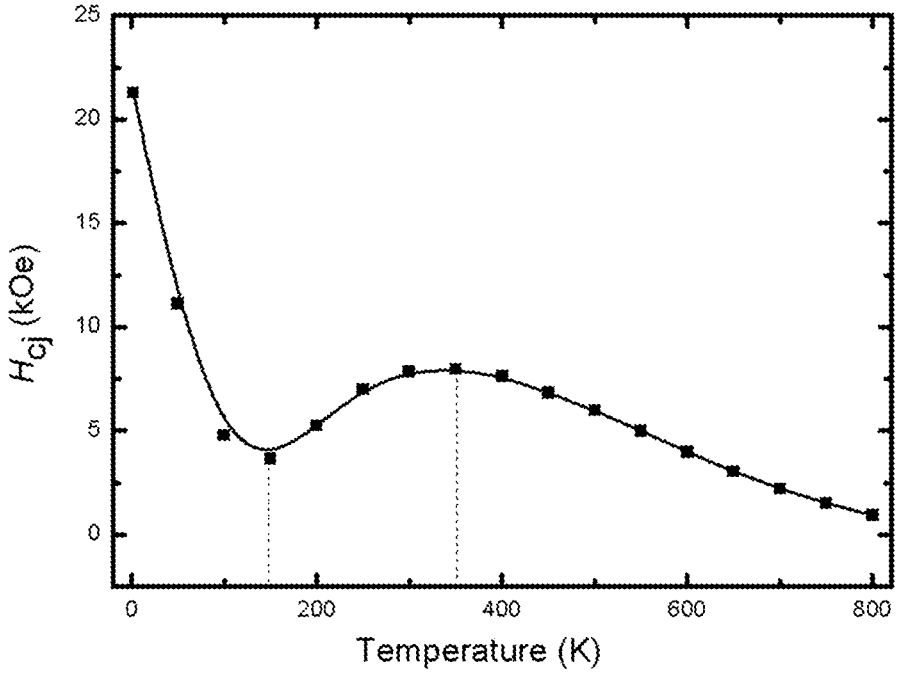
FIG. 2 is a relationship between the coercivity and the temperature of the permanent magnet material obtained in embodiment 1 of the present disclosure.

The tests of alternating current magnetic susceptibility and magnetic properties were performed on the Samarium-Cobalt based permanent magnet obtained in embodiment 1. FIG. 1 shows the alternating current magnetic susceptibility test result. From FIG. 1, it can be seen that the spin reorientation transition temperature of the $(SmHreR)(CoM)_5$ compound of the Samarium-Cobalt based permanent magnet is about 163K. FIG. 2 shows the relationship between the coercivity and the temperature. From FIG. 2, it shows that the coercivity firstly decreases, then rises and finally decreases as the temperature increases, and the positive temperature coefficient of coercivity is in a temperature range of 150K to 350K.

The magnetism stabilizing treatment was performed as follows: the Samarium-Cobalt based permanent magnet was magnetized and saturated at 300K in a 5 T magnetic field, and then the Samarium-Cobalt based permanent magnet was magnetism stabilized as the temperature decreased to 200K at a rate of 5 K per minute and then rise to 300K at a rate of 5 K per minute. The irreversible magnetic flux loss rate of the Samarium-Cobalt based permanent magnet was about 4.1%.

Embodiment 2

The Samarium-Cobalt based permanent magnet in embodiment 2 was the same as that in the embodiment 1.

The magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature decreased to 150K at a rate of 5 K per minute and then rise to 300K at a rate of 5 K per minute. The irreversible magnetic flux loss rate of the Samarium-Cobalt based permanent magnet was about 6.3%.

Embodiment 3

The Samarium-Cobalt based permanent magnet in embodiment 3 was the same as that in the embodiment 1.

The magnetism stabilizing treatment was performed as follows: the Samarium-Cobalt based permanent magnet was magnetized and saturated at 300K in a 5 T magnetic field, and then the Samarium-Cobalt based permanent magnet was magnetism stabilized as the temperature decreased to 100K at a rate of 5 K per minute and then rise to 300K at a rate of 5 K per minute. The irreversible magnetic flux loss rate of the Samarium-Cobalt based permanent magnet was about 6.3%.

The irreversible magnetic flux loss rate of Embodiment 3 was equal to that of embodiment 2. From this, it can be known that as long as the temperature is lower than the lowest temperature $T_1$ of the temperature interval of the positive temperature coefficient of coercivity of the permanent magnet material during the process of the magnetism stabilizing treatment, the irreversible magnetic flux loss rate of the permanent magnet material is substantially constant. That is, in the Samarium-Cobalt based permanent magnets, when the temperature of the magnetism stabilizing treatment is lower than 150K, the irreversible magnetic flux loss rate of the s Samarium-Cobalt based permanent magnets is substantially constant. This shows that the method for magnetism stabilizing treatment is less affected by temperature and time, and is an efficient and uniform magnetic stabilization method.

Embodiment 4

The Samarium-Cobalt based permanent magnet in embodiment 4 was the same as that in the embodiment 1.

The magnetism stabilizing treatment was performed as follows: the Samarium-Cobalt based permanent magnet was magnetized and saturated for 480 hours at 300K in a 5 T magnetic field. The irreversible magnetic flux loss rate of the Samarium-Cobalt based permanent magnet was about 0.01%. It can be seen that after magnetization, the magnetism stabilizing treatment is performed at a constant temperature of 300K. Although the magnetism stabilizing effect can be achieved, the unstable magnetized regions of the permanent magnet material itself are difficult to undergo magnetic inversion in a short time, and rapid magnetic stabilization effect cannot be achieved in a short time.

Embodiment 5

A Samarium-Cobalt based permanent magnet was prepared as following.

A $(Sm_{0.5}Gd_{0.5})Co_5$ permanent magnetic material was used as a strong magnetic phase, and $DyCo_5$ was used as a magnetic phase with spin reorientation transition. A $(Sm_{0.5}Gd_{0.5})Co_5$ permanent magnet material film and a $DyCo_5$ film were prepared respectively by magnetron sputtering method, so that a multi-layer structure including a plurality of $(Sm_{0.5}Gd_{0.5})Co_5$ permanent magnet material films and a plurality of $DyCo_5$ films alternately stacked with each other layer by layer was obtained. Each of the $(Sm_{0.5}Gd_{0.5})Co_5$ permanent magnet material film and the $DyCo_5$ film had a thickness in a range from about 5 nanometers to about 800 nanometers. A spin reorientation transition temperature of $DyCo_5$ compound is 350K. The Samarium-Cobalt based permanent magnet has a positive temperature coefficient of coercivity in the temperature range from 200K to 400K.

The magnetism stabilizing treatment was performed as follows: the Samarium-Cobalt based permanent magnet was magnetized and saturated at 300K in a 5 T magnetic field, and then the Samarium-Cobalt based permanent magnet was magnetism stabilized as the temperature decreased to 100K at a rate of 5 K per minute and then rise to 300K at a rate of 5 K per minute. The irreversible magnetic flux loss rate of the Samarium-Cobalt based permanent magnet was about 7%.

Embodiment 6

A commercial ferrite magnet with a positive temperature coefficient of coercivity was selected, and the positive temperature coefficient of coercivity was in the temperature range from 10K to 500K.

The magnetism stabilizing treatment was performed as follows: the ferrite magnet was magnetized and saturated at 300K in a 5 T magnetic field, and then the ferrite magnet was magnetism stabilized as the temperature decreased to 100K at a rate of 5 K per minute and then rise to 300K at a rate of 5 K per minute. The irreversible magnetic flux loss rate of the ferrite magnet was about 3%. It is indicated that the magnetism stabilizing treatment can be performed under the room temperature, and the unstable magnetized regions of the magnet can be prone to magnetic inversion, resulting in magnetic stabilization. It is also proved that the method can be applied for all the permanent magnet materials having the positive temperature coefficient of coercivity.

Comparative Embodiment 1

The Samarium-Cobalt based permanent magnet in comparative embodiment 1 was the same as that in the embodiment 1.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 500K at a rate of 5 K per minute and then decreased to 300K at a rate of 5 K per minute. The irreversible magnetic flux loss rate of the Samarium-Cobalt based permanent magnet was about 1.8%.

Comparative Embodiment 2

The Samarium-Cobalt based permanent magnet in comparative embodiment 2 was the same as that in embodiment 1.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 600K at a rate of 5 K per minute and then decreased to 300K at a rate of 5 K per minute. The irreversible magnetic flux loss rate of the Samarium-Cobalt based permanent magnet was about 2.9%.

Comparative Embodiment 3

The Samarium-Cobalt based permanent magnet in comparative Embodiment 3 was the same as that in the embodiment 1.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 650K at a rate of 5 K per minute and then decreased to 300K at a rate of 5 K per minute. The irreversible magnetic flux loss rate of the Samarium-Cobalt based permanent magnet was about 4.4%.

Comparative Embodiment 4

The Samarium-Cobalt based permanent magnet in comparative embodiment 4 was the same as that in the embodiment 1.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 700K at a rate of 5 K per minute and then decreased to 300K at a rate of 5 K per minute. The irreversible magnetic flux loss rate of the Samarium-Cobalt based permanent magnet was about 6.3%.

Figure 3:
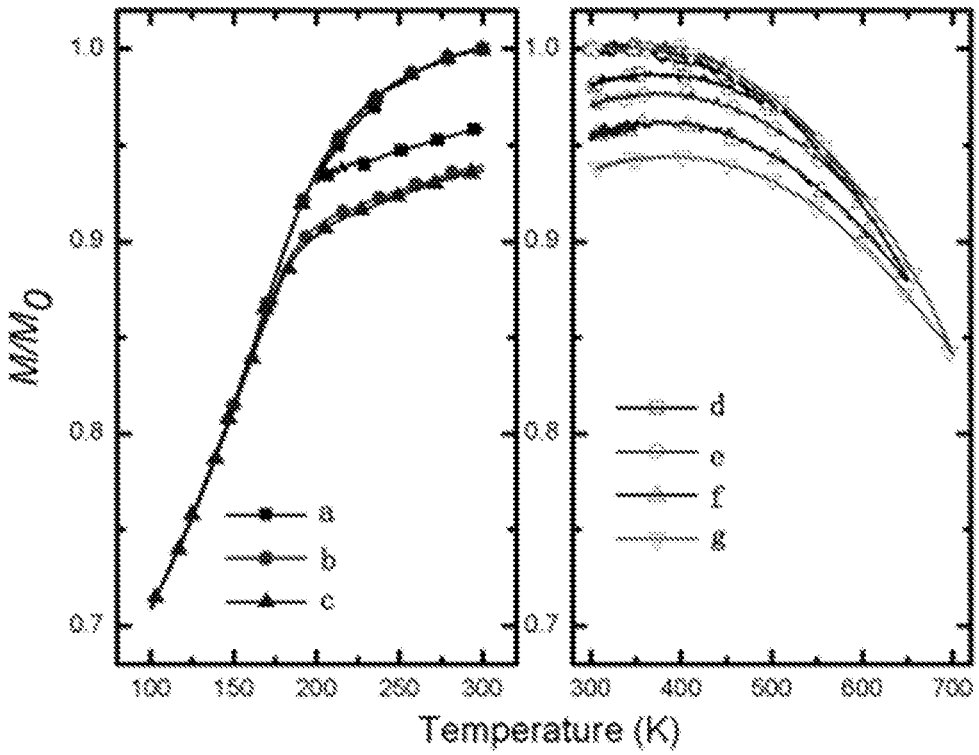
FIG. 3 is magnetic moment change curves of permanent magnet materials obtained in embodiments 1 to 4, and comparative embodiments 1 to 4, in the magnetism stabilizing treatment, wherein "a" is corresponding to embodiment 1, "b" is corresponding to embodiment 2, "c" is corresponding to embodiment 3, "d" is corresponding to comparative embodiment 1, "e" is corresponding to comparative embodiment 2, and "f" is corresponding to comparative embodiment 3.

Referring to FIG. 3, the coercivity of the Samarium-Cobalt based permanent magnet in embodiment 2 is approximately equal to that of the Samarium-Cobalt based permanent magnet in comparative embodiment 2, but the irreversible magnetic flux loss rate of the Samarium-Cobalt based permanent magnet in comparative embodiment 2 is only 46% of that of the Samarium-Cobalt based permanent magnet in embodiment 2. It is indicated that, in the temperature range from $T_3$ to $T_4$, the spin reorientation of the magnetic phase with spin reorientation transition can play an important positive role in the rapid magnetic stabilization process in the method for magnetism stabilizing treatment of the present disclosure.

Comparative Embodiment 5

The Samarium-Cobalt based permanent magnet in comparative embodiment 5 was the same as that in the embodiment 1. The Samarium-Cobalt based permanent magnet was without magnetism stabilizing treatment.

Figure 4:
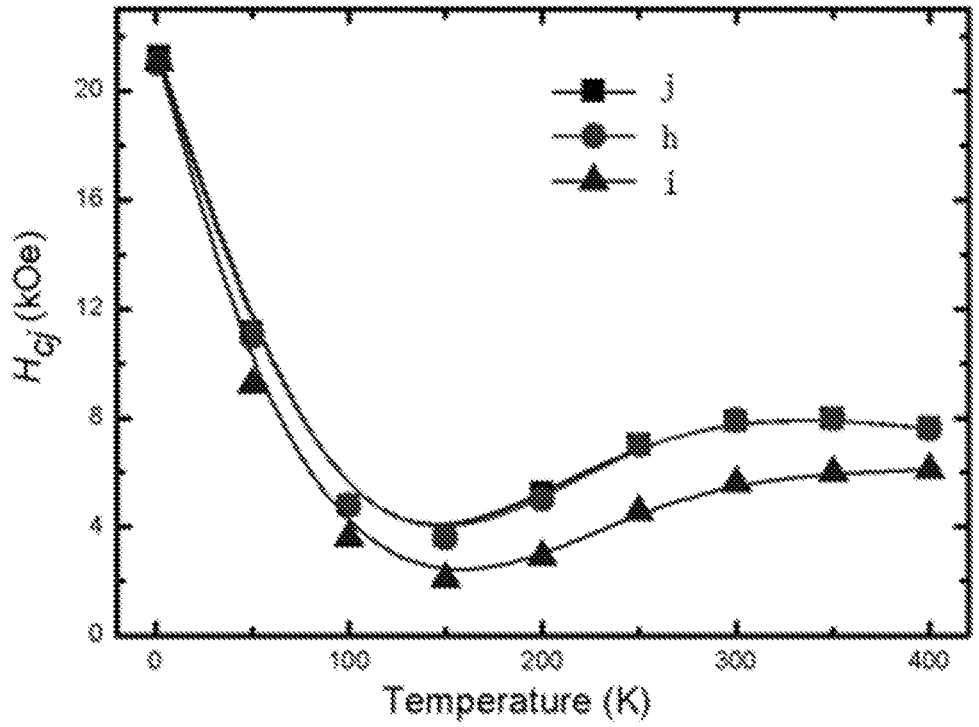
FIG. 4 is a relationship between the coercivity and the temperature of the permanent magnet materials obtained in embodiment 3, and comparative embodiments 1 and 5, wherein "h" is corresponding to embodiment 3, "i" is corresponding to comparative embodiment 1, and "j" is corresponding to comparative embodiment 5.

Referring to FIG. 4, the coercivity of the Samarium-Cobalt based permanent magnet in embodiment 3 is substantially the same as that of the Samarium-Cobalt based permanent magnet in comparative embodiment 5. After the high temperature magnetism stabilizing treatment of Comparative Embodiment 1, the coercivity of the Samarium-Cobalt based permanent magnet is relatively low due to the destruction of the chemical structure of the Samarium-Cobalt based permanent magnet by the high temperature. It can be known that the method for magnetism stabilizing treatment of the present disclosure does not damage the chemical structure of the magnet, and makes up for the shortcomings of the high temperature magnetism stabilizing treatment.

Comparative Embodiment 6

A Samarium-Cobalt based permanent magnet was prepared as following.

The Samarium-Cobalt based permanent magnet consisting essentially of elements Sm, Co, Fe, Cu, Zr, Gd, and Dy was prepared. Percentage of mass of the element of Sm was about 12.90%, percentage of mass of the element of Co was about 50.61%, percentage of mass of the element of Fe was about 13.80%, percentage of mass of the element of Cu was about 6.28%, percentage of mass of the element of Zr was about 2.82%, percentage of mass of the element of Gd was about 10.79%, and percentage of mass of the element of Dy was about 2.79%. Hre was the combination of Gd and Dy with percentage of mass of about 13.58%, Dy was also the element of R, and the percentage of mass of R was about 2.79%.

The method for preparing the Samarium-Cobalt based permanent magnet is as follows:

S100: providing a raw material including elements Sm, Co, Fe, Cu, Zr, Gd, and Dy in accordance with above percentages of mass;

S200: smelting the raw material in an induction smelting furnace to obtain an alloy ingot, then crushing the alloy ingot to form grains, and jet milling or ball milling the grains to obtain magnet powder;

S300: shaping the magnet powder obtained in step S200 under a protection of nitrogen gas and in a magnetic field with an intensity of about 2 T to form a preform, and then cold isostatic pressing the preform for about 60 seconds under the pressure of about 200 Mpa to obtain a magnet body;

S400: sintering the magnet body obtained in step S300 in a vacuum sintering furnace with an air pressure below 4 mPa and under a protection of argon gas. The process of sintering the magnet body was performed as following: the vacuum sintering furnace was firstly heated to a temperature from 1200 degree centigrades to 1215 degree centigrades and kept at this temperature for about 30 minutes for sintering; the vacuum sintering furnace was then cooled to a temperature from 1160 degree centigrades to 1190 degree centigrades and kept at this temperature for about 3 hours for solid solution; afterwards the vacuum sintering furnace was cooled to room temperature by air cooling or water cooling; the vacuum sintering furnace was heated to about 830 degree centigrades and isothermal aging for about 12 hours at this temperature; the vacuum sintering furnace was cooled to about 400 degree centigrades with a cooling speed of about 0.7 degree centigrades per minute and kept at this temperature for about 3 hours; and then the vacuum sintering furnace was rapidly cooled to room temperature, and finally the Samarium-Cobalt based permanent magnet was obtained.

In this comparative embodiment 6, the microstructure of the Samarium-Cobalt based permanent magnet was a cellular structure composed of a $(SmHreR)(CoM)_5$ compound and a $(SmHreR)_2(CoM)_{17}$ compound. The $(SmHreR)(CoM)_5$ compound was a cell boundary phase, the $(SmHreR)_2(CoM)_{17}$ compound was a intracellular phase, the crystalline structure of the $(SmHreR)_2(CoM)_{17}$ compound was a rhombic structure, the crystalline structure of the $(SmHreR)(CoM)_5$ compound was a hexagonal structure, and the Cu element concentrates in the $(SmHreR)(CoM)_5$ compound of the cell boundary phase.

Figure 5:
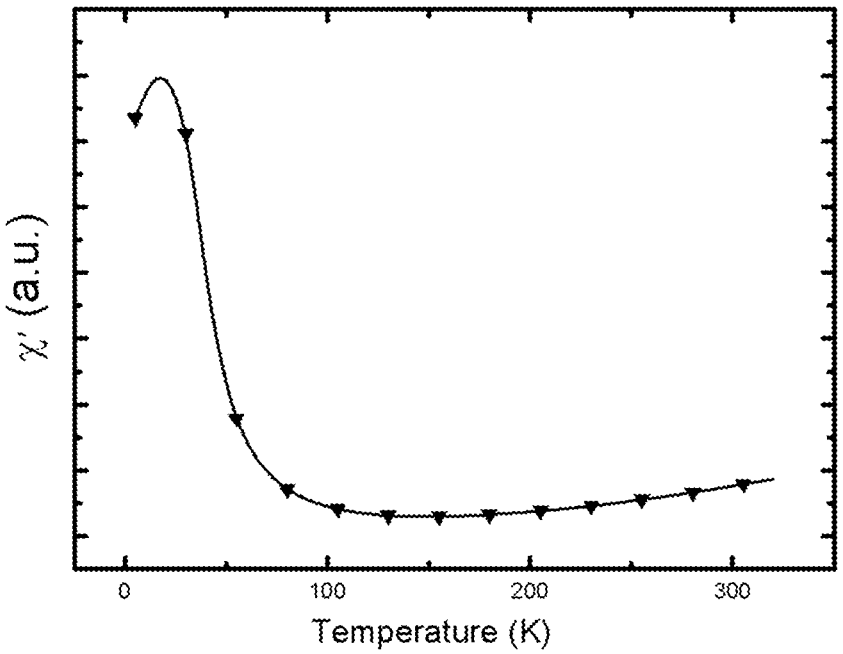
FIG. 5 is an AC magnetic susceptibility test result of the permanent magnet material obtained in comparative embodiment 6.
Figure 6:
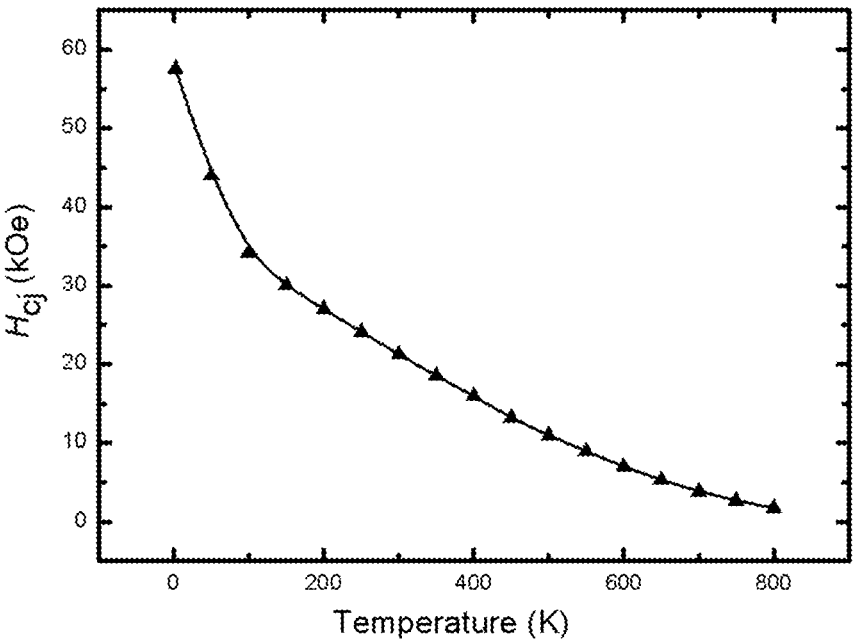
FIG. 6 is a relationship between the coercivity and the temperature of the permanent magnet material obtained in comparative embodiment 6.

The tests of alternating current magnetic susceptibility and magnetic properties were performed on the Samarium-Cobalt based permanent magnet obtained in comparative embodiment 6. FIG. 5 shows the alternating current magnetic susceptibility test result. From FIG. 5, it can be seen that the spin reorientation transition temperature of the $(SmHreR)(CoM)_5$ compound of the Samarium-Cobalt based permanent magnet is about 18K. FIG. 6 shows the relationship between the coercivity and the temperature. From FIG. 6, it shows that the coercivity of the Samarium-Cobalt based permanent magnet decreases as the temperature increases, and Samarium-Cobalt based permanent magnet has no positive temperature coefficient of coercivity.

The magnetism stabilizing treatment was performed as follows: the Samarium-Cobalt based permanent magnet was magnetized and saturated at 300K in a 5 T magnetic field, and then the Samarium-Cobalt based permanent magnet was magnetism stabilized as the temperature decreased to 200K at a rate of 5 K per minute and then rise to 300K at a rate of 5 K per minute. The irreversible magnetic flux loss rate of the Samarium-Cobalt based permanent magnet was about 0%.

Comparative Embodiment 7

The Samarium-Cobalt based permanent magnet in comparative embodiment 7 was the same as that in the comparative embodiment 6.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature decreased to 150K at a rate of 5 K per minute and then rise to 300K at a rate of 5 K per minute. The irreversible magnetic flux loss rate of the Samarium-Cobalt based permanent magnet was about 0%.

Comparative Embodiment 8

The Samarium-Cobalt based permanent magnet in comparative embodiment 8 was the same as that in the comparative embodiment 6.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature decreased to 100K at a rate of 5 K per minute and then rise to 300K at a rate of 5 K per minute. The irreversible magnetic flux loss rate of the Samarium-Cobalt based permanent magnet was about 0%.

Comparative Embodiment 9

The Samarium-Cobalt based permanent magnet in comparative embodiment 9 was the same as that in the comparative embodiment 6.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 500K at a rate of 5 K per minute and then decrease to 300K at a rate of 5 K per minute. The irreversible magnetic flux loss rate of the Samarium-Cobalt based permanent magnet was about 1.5%.

Comparative Embodiment 10

The Samarium-Cobalt based permanent magnet in comparative embodiment 10 was the same as that in the comparative embodiment 6.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 600K at a rate of 5 K per minute and then decrease to 300K at a rate of 5 K per minute. The irreversible magnetic flux loss rate of the Samarium-Cobalt based permanent magnet was about 2.2%.

Comparative Embodiment 11

The Samarium-Cobalt based permanent magnet in comparative embodiment 11 was the same as that in the comparative embodiment 6.

A high temperature magnetism stabilizing treatment was performed as follows: the Samarium-Cobalt based permanent magnet was magnetized and saturated at 300K in a magnetic field with an intensity of about 5 T, and then the Samarium-Cobalt based permanent magnet was magnetism stabilized as the temperature rise to 700K at a rate of 5 K per minute and then decrease to 300K at a rate of 5 K per minute. The irreversible magnetic flux loss rate of the Samarium-Cobalt based permanent magnet was about 3.6%.

Figure 7:
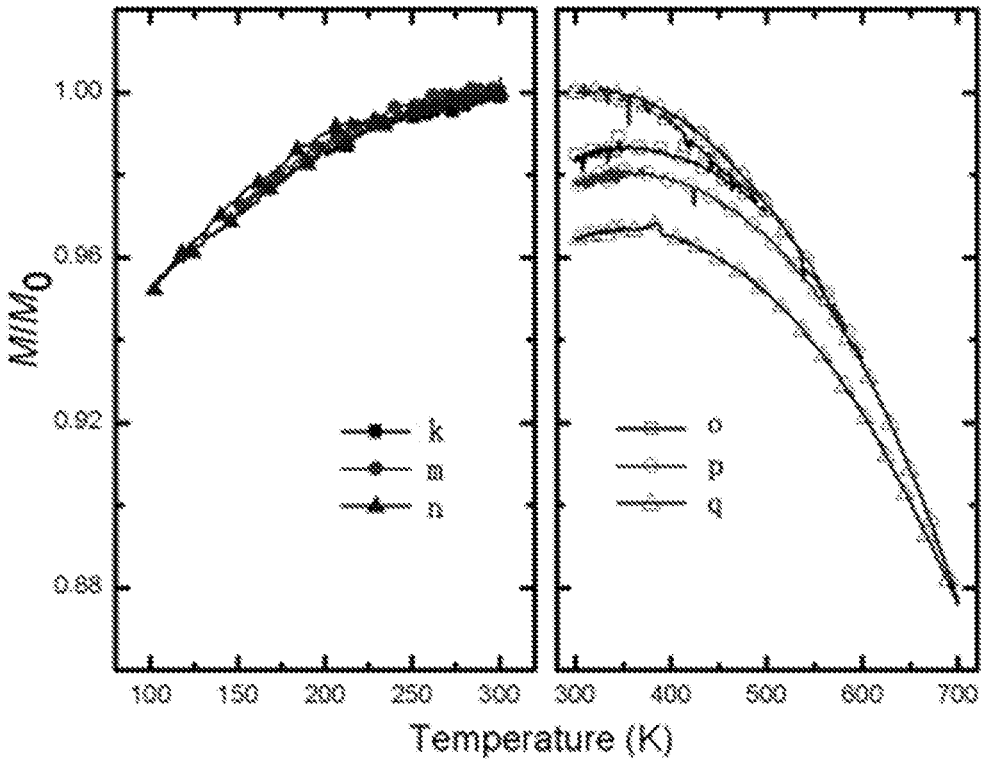
FIG. 7 is magnetic moment change curves of permanent magnet materials obtained in comparative embodiments 6 to 11, wherein "k" is corresponding to comparative embodiment 6, "m" is corresponding to comparative embodiment 7, "n" is corresponding to comparative embodiment 8, "o" is corresponding to comparative embodiment 9, "p" is corresponding to comparative embodiment 10, and "q" is corresponding to comparative embodiment 11.

Referring to FIG. 7, the positive temperature coefficient of coercivity is a necessary condition for achieving the low temperature magnetism stabilizing treatment. For a magnet without the positive temperature coefficient of coercivity, the low temperature magnetism stabilizing treatment is not applicable.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A method for treating a permanent magnet material, wherein the method comprises the following steps:

providing a permanent magnet material having a positive temperature coefficient of coercivity, the permanent magnet material comprises a microstructure having a first magnetic phase and a second magnetic phase, the first magnetic phase and the second magnetic phase are isolated from each other, the first magnetic phase is a magnetic phase with uniaxial anisotropy, and the second magnetic phase is a magnetic phase with spin reorientation transition, the coercivity of the permanent magnet material firstly decreases, then rises and finally decreases as the temperature increases, the permanent magnet material has the positive temperature coefficient of coercivity in a temperature range of $T_1$ to $T_2$, $T_2$ is the maximum temperature of the temperature range of the positive temperature coefficient of coercivity;

magnetizing the permanent magnet material at a temperature $T_3$; and cooling the permanent magnet material to a temperature $T_4$, and then raising the temperature to $T_3$ again to perform a magnetism stabilizing treatment towards the permanent magnet material at a temperature range between the temperature $T_3$ and the temperature $T_4$, to make an easy magnetization direction of the second magnetic phase converse from easy plane to easy axis as temperature decreases, $T_3$ is 300K, $T_4$ is in a range of 100K to 200K, and the temperature $T_2$ is higher than or equal to the temperature $T_4$.

2. The method of claim 1, wherein the positive temperature coefficient of coercivity is in a temperature range of 10K to 600K.

3. The method of claim 1, wherein the first magnetic phase is a SmCo compound, the second magnetic phase is a $RCo_5$ compound, a derivative compound of the $RCo_5$ compound, a $R_2Co_{17}$ compound, a derivative compound of the $R_2Co_{17}$ compound, or a combination thereof, wherein R is Pr, Nd, Dy, Tb, Ho, or a combination thereof.

4. The method of claim 1, wherein the permanent magnet material is a Samarium-Cobalt based permanent magnet;

the Samarium-Cobalt based permanent magnet comprises a magnetic phase of $(SmHreR)_2(CoM)_{17}$ compound having uniaxial anisotropy and a magnetic phase of $(SmHreR)(CoM)_5$ compound having spin reorientation transition, the $(SmHreR)(CoM)_5$ compound encapsulates the $(SmHreR)_2(CoM)_{17}$ compound in a microstructure of the Samarium-Cobalt based permanent magnet;

Hre is Gd, Tb, Dy, Ho, Er, Tm, Yb, Lu, or a combination thereof, R is Pr, Nd, Dy, Tb, Ho, or a combination thereof, M is Fe, Cu, Zr, Ni, Ti, Nb, Mo, Hf, W, or a combination thereof, and the SmHreR comprises at least three elements.

5. The method of claim 4, wherein in the Samarium-Cobalt based permanent magnet, a percentage of mass of R is from 8% to 20%, and a percentage of mass of Hre is from 8% to 18%.

* * * * *